United States Patent [19]

MacMillan

[11] 4,449,331

[45] May 22, 1984

[54] SHOT BLASTING MACHINERY

[75] Inventor: William R. MacMillan, Sale, England

[73] Assignee: Tiglhman Wheelabrator Limited, Altrincham, England

[21] Appl. No.: 354,693

[22] Filed: Mar. 4, 1982

[30] Foreign Application Priority Data

Mar. 17, 1981 [GB] United Kingdom ..... 8108333

[51] Int. Cl.[3] ..... B24C 3/04

[52] U.S. Cl. ..... 51/425; 51/426

[58] Field of Search ..... 51/424, 425, 426, 418, 51/417, 420, 421, 431, 432; 241/175

[56] References Cited

U.S. PATENT DOCUMENTS

| | | | |
|---|---|---|---|
| 1,214,641 | 2/1917 | Billings | 51/426 X |
| 1,710,604 | 4/1929 | Billings | 51/424 X |
| 1,710,612 | 4/1929 | Fatscher et al. | 51/424 X |
| 2,996,846 | 8/1961 | Leliaert | 51/425 X |
| 3,097,450 | 7/1963 | Freeman et al. | 51/425 X |
| 3,097,451 | 7/1963 | Freeman et al. | 51/425 X |
| 3,540,156 | 11/1970 | Stebbins | 51/425 X |
| 4,031,666 | 6/1977 | West | 51/425 X |

*Primary Examiner*—Frederick R. Schmidt
*Assistant Examiner*—Robert A. Rose
*Attorney, Agent, or Firm*—Sughrue, Mion, Zinn, Macpeak, and Seas

[57] ABSTRACT

A shot blasting module is adapted for communicating assembly with a blast cabinet module. The slot blasting module comprises a casing housing at least one hoodless abrasive throwing wheel assembly, preferably door mounted, an abrasive/contaminant separator, and a two-stage vertical conveyor. The conveyor is an endless belt with two parallel rows of buckets, one of which directs spent abrasive and contaminants delivered from the blast cabinet module into the shot blasting module into the separator, while the other row simultaneously delivers clean abrasive into a storage hopper from which it is directed to the throwing wheel assembly. A dust collector module is preferably combined with the shot blasting module and the blast cabinet module.

13 Claims, 7 Drawing Figures

SHOT BLASTING MACHINERY

This invention relates to shot blasting machinery and it is an object of the present invention to provide a shot blasting machine of versatile and variable construction.

According to one aspect of the present invention there is provided a shot blasting module adapted for communicating assembly with a blast cabinet module, the shot blasting module comprising a casing housing at least one abrasive throwing wheel assembly, an abrasive/contaminant separator, and a two-stage vertical conveyor means adapted simultaneously to direct spent abrasive and contaminants delivered from the blast cabinet module into the shot blasting module into the separator, and to deliver clean abrasive into a storage hopper from which it is directed to the throwing wheel assembly.

Preferably the or each throwing wheel assembly is mounted on a swing-out door of the casing which facilitates maintenance and avoids the need to provide an externally mounted hood within which such throwing wheel assemblies are conventionally housed as is well known to those skilled in the art.

In a modification, the or each wheel assembly is mounted on a wall of the casing, at least one door being provided for access. Here again, no hood is required.

The delivery of abrasive from the storage hopper to the or each throwing wheel assembly is preferably via a control valve. If there is more than one control valve (i.e. more than one throwing wheel assembly) then the valves are preferably independently operable.

Preferably, the throwing wheel assembly, in use, is housed in a wear-resistant lined compartment of the module casing. The compartment is formed of, or lined with, manganese for example.

The conveyor means preferably comprises an endless belt carrying two parallel rows of buckets, which belt is driven at the top by a geared motor, preferably fitted with an anti-run back device.

The fact that the elevator motor is the only motor additional to the throwing wheel assembly motor or motors in the shot blasting module renders the machine a low energy user.

There is thus provided a shot blasting module which, when compared with known shot blasting machinery, is self-contained, i.e. all the operative components are housed within the casing, and is of lesser height, due to the provision of the two-stage conveyor, thus permitting its installation in locations of restricted headroom.

The blast cabinet module may be of any convenient construction including, inter alia, a swing table, a hanger arrangement, a continuous conveyor, and an endless in-out conveyor.

According to a second aspect of the present invention there is provided a shot blasting machine comprising, in combination, a blast cabinet module and a shot blasting module as hereinbefore defined in the preceding paragraphs.

Preferably the machine also comprises, in combination, a dust collector module.

It will be manifest that the number and arrangement of modules constituting the shot blasting machine can be varied to suit a customer's particular requirements.

An embodiment of the present invention will now be described, by way of example, with reference to the accompanying drawings, in which.

Figure 1:
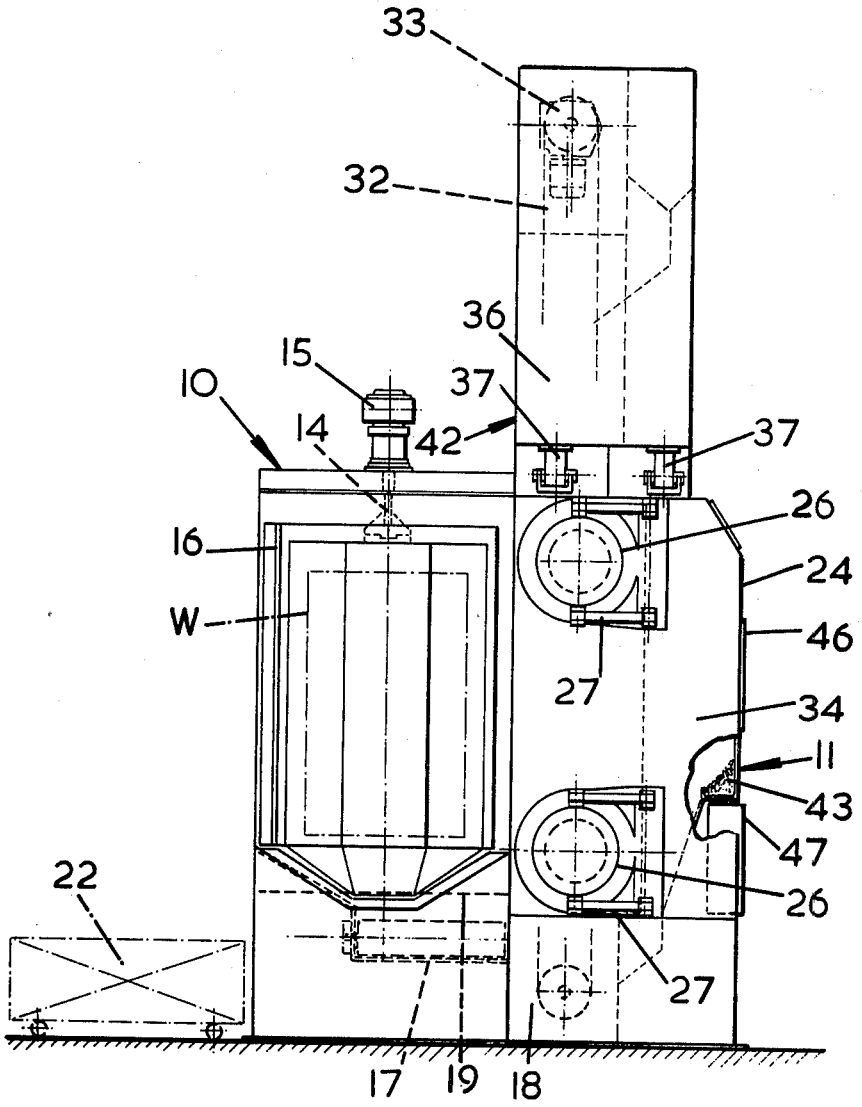
FIG. 1 is a front elevation of a modular shot blasting machine according to the invention.
Figure 2:
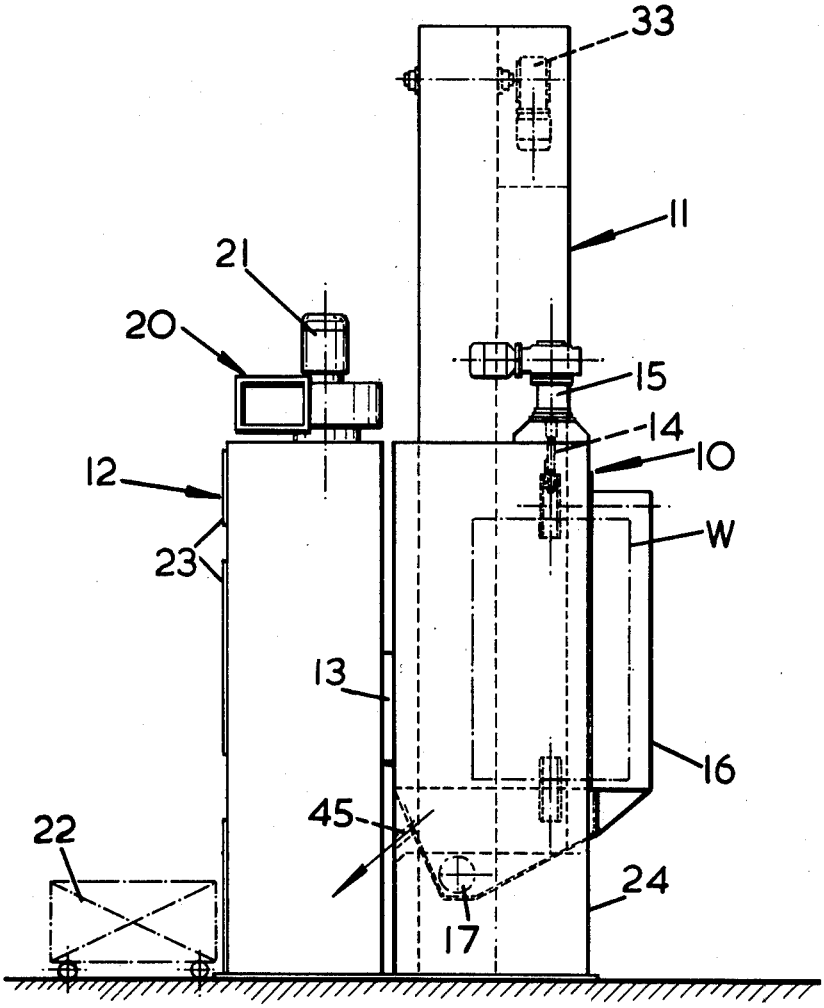
FIG. 2 is a corresponding end elevation.

The shot blasting machine comprises a blast cabinet module 10, a shot blasting module 11 and a dust collector module 12, all assembled together in the disposition shown and with the shot blasting module 11 in communication with the blast cabinet module 10 which is, in turn, in communication with the dust collector module 12.

The blast cabinet module 10 is directly connected to the shot blasting module 11, i.e. no intervening ductwork, but is connected to the dust collector module 12 through the intermediary of a manifold spigot 13 which facilitates connection and which makes re-siting it relative to the blast cabinet module 10 easier.

In this embodiment, the blast cabinet module 10 includes, for the workpiece W, a hanger 14 rotatable by a geared motor 15 to ensure that all surfaces of the workpiece W are presented to the cleaning stream of abrasive emanating from the shot blasting module 11.

The blast cabinet module 10 has a hinged work access door 16 projecting outwards from the front of the module to provide ease of access to the workpiece W.

The blast cabinet module 10 is of pitless design as can be seen, it has, as is customary, on its inner wall surfaces easily replaceable hook-on wear tiles (not shown). A screw conveyor 17 returns spent, i.e. re-usable, abrasive and contaminants to the boot 18 of the shot blasting module 11.

The blast cabinet module 10 has a perforated floor plate 19 disposed above the screw conveyor 17 to ensure that large pieces of contaminant are retained in the blast cabinet module 10 for eventual removal.

An adjustable metering or surge plate (not shown) is arranged below the perforated floor plate 19 and above the screw conveyor 17 to ensure that the screw conveyor is not flooded with spent abrasive and contaminants thereby avoiding blockage of the screw conveyor.

The dust collector module 12 has a top mounted dust exhaust fan 20 driven by a motor 21. It is, for example, a continuously-operating filter unit and the exhaust fan 20 provides a constant rate of air extraction volume from the blast cabinet module 10.

The dust collector module 12 contains filter elements and has a silencer on the exhaust fan 20, neither of these components being shown.

Air from the dust collector module 12 is returned back to the workshop as can readily be seen which eliminates loss of heat to atmosphere thus giving considerable savings in workshop heating costs.

Figure 3:
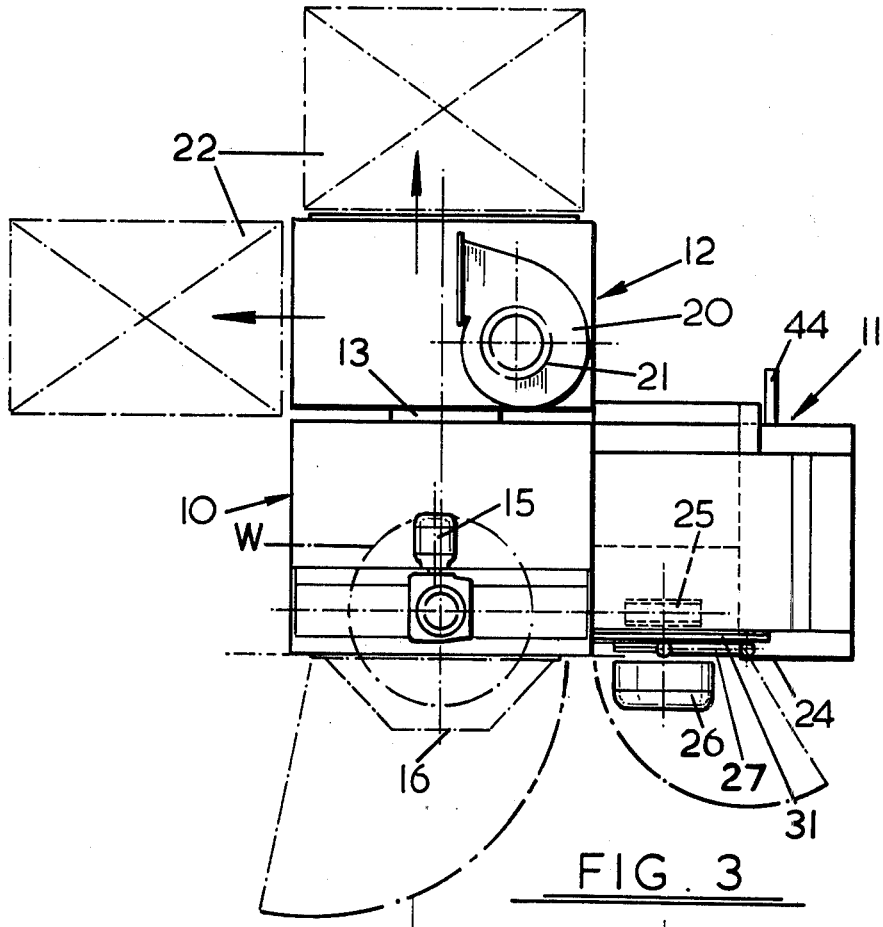
FIG. 3 is a corresponding plan view.
Figure 4:
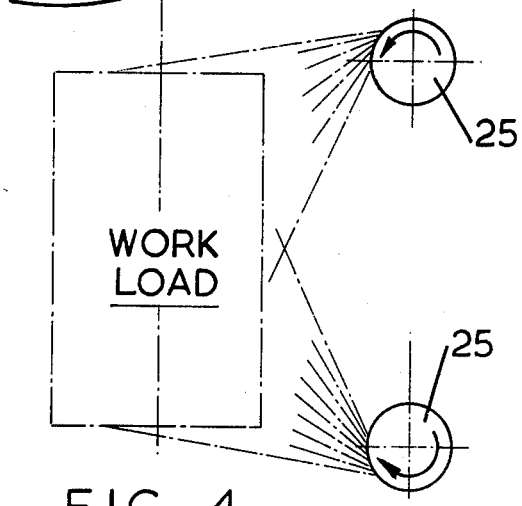
FIG. 4 is a view showing a typical blast pattern for a given machine.

The dust collector module 12 embodies an automatic cleaning system well-known in the art and which causes dust to fall into a dust collecting trolley 22 which can be withdrawn from the dust collector module 12 for dust disposal. Alternative withdrawal locations are indicated in FIG. 3.

An access door to the dust collector module 12 is indicated at 23.

Reference is now made to the shot blasting module 11 which, as aforesaid, is in direct communication, i.e. no intervening ductwork with the blast cabinet module 10.

Figure 5:
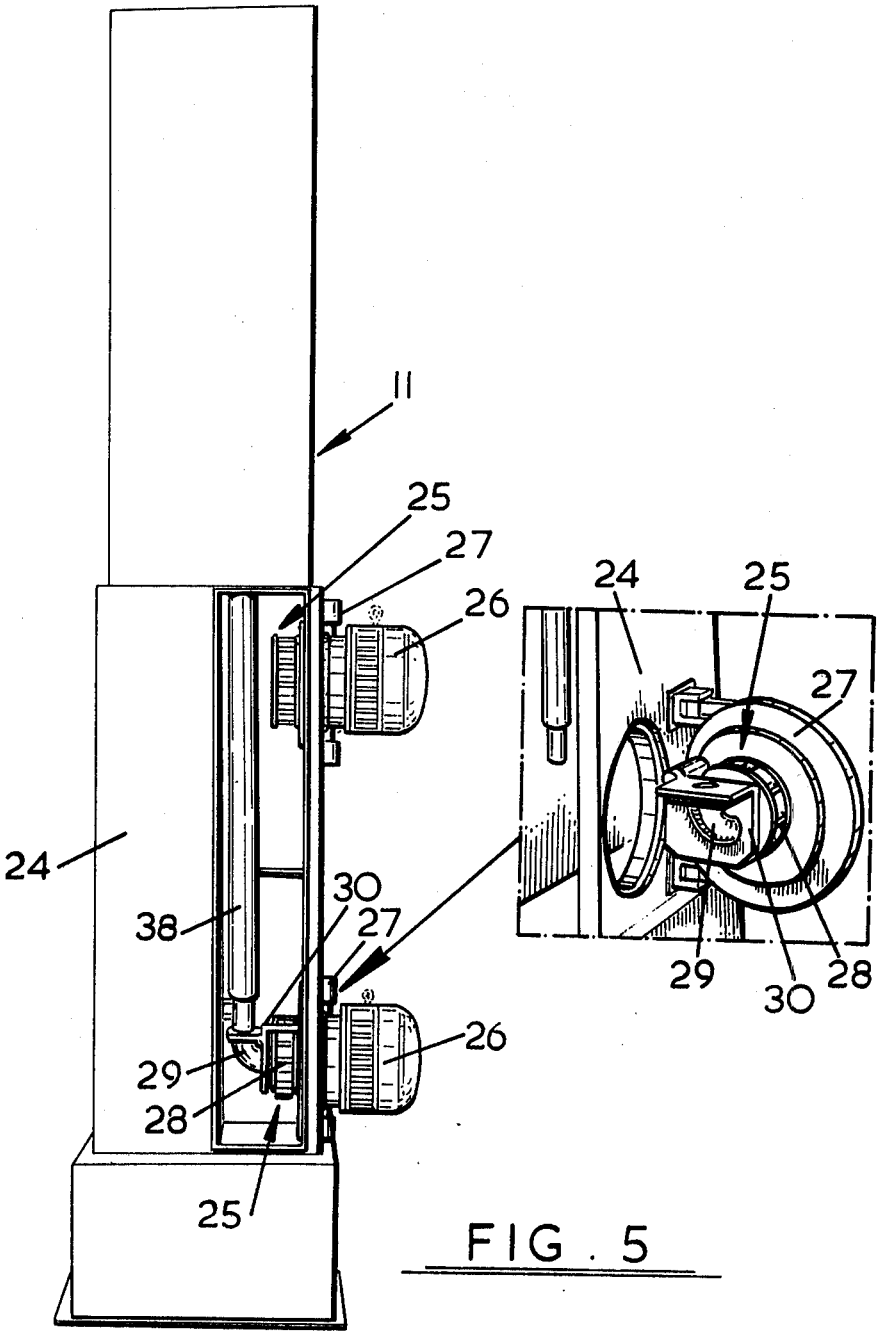
FIG. 5 is a fragmentary side elevation and detail view of the shot blasting module.

This shot blasting module 10 comprises a casing 24 defining a compartment which is normally manganese lined and houses two vertically-spaced reversible throwing wheel assemblies 25 such, for example, as are disclosed in our United Kingdom Pat. No. 1 500 092. Each throwing wheel assembly 25 is, as can be seen in FIG. 5, hoodless and is driven by a low-noise, direct-coupled, flange-mounted, totally enclosed motor 26. Each throwing wheel assembly 25 and its motor 26 is mounted on a swing-out door 27 for ease of access. The basic construction of such abrasive throwing wheel assemblies are very well known to those skilled in the art and will not therefore be described in detail. The throwing wheel is indicated by reference 28 and its abrasive delivery spout by reference 29. The spout 29 is secured to the door 27 by a bracket 30.

Each door opening is provided with an apertured rubber sealing plate 31 through which the throwing wheel assembly 25 passes and into which a flange of the motor 26 engages to provide an anti-vibration feature and sealing against abrasive egress from the manganese-lined compartment.

The throwing wheel assemblies 25 incorporate anti-vibration mountings and their motors 26 have heavy duty shafts and bearings and are thyristor protected.

The shot blasting module 11 also incorporates an elevator means and a separator.

The elevator means is an endless belt conveyor 32 carrying two parallel rows of lifting buckets A and B and is driven at its top by a totally enclosed geared motor 33 which reduces noise levels.

Figure 6:
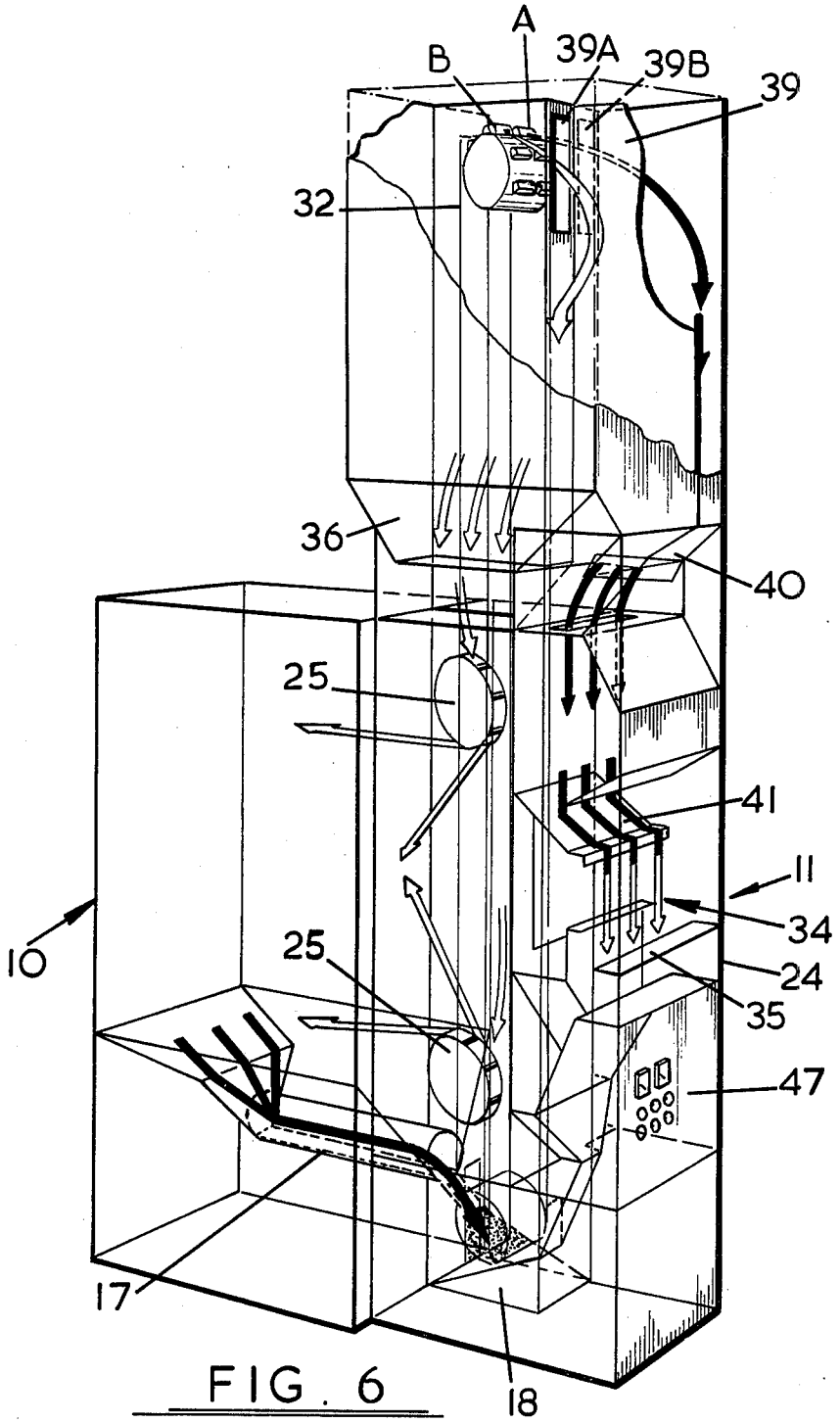
FIG. 6 is a diagrammatic perspective view of the shot blasting module.
Figure 7:
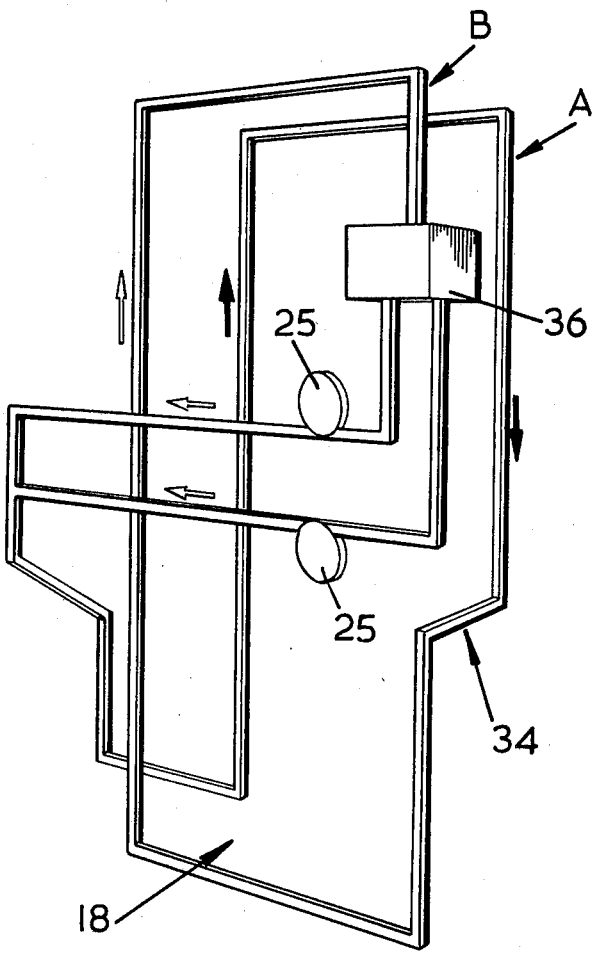
FIG. 7 is a schematic flow diagram showing clean and dirty abrasive paths through the machine.

The conveyor 32 can handle both clean and spent abrasive simultaneously while keeping both separate as can clearly be seen from FIGS. 6 and 7.

The conveyor 32 is fitted with a run back prevention locking device (not shown).

The conveyor 32 is fitted with sealed-for-life bearings and is provided with a floor level screw tensioning arrangement (not shown).

The conveyor 32 has two parallel and separate rows of buckets designated, as aforesaid, A and B. Bucket row A serves (see FIGS. 6 and 7) to raise spent abrasive and contaminants from the boot 18 of the shot blasting module 11 and deliver same by gravity to a separator 34 from which clean abrasive is returned to the boot 18. Separation of contaminants from the abrasive is effected by passing an air stream through the falling abrasive. As the abrasive falls through the separator 34 by gravity the only power required in operation of the separator is that needed to generate the air flow which, of course contributes to the overall energy economy of the machine. A sieve 35, which may be removable, is disposed below this air wash separator 34 for final cleaning prior to the cleaned abrasive passing into the boot 18. The bucket row B conveys clean abrasive to a storage hopper 36 from which abrasive is fed via a control valve 37 and a pipe 38 to the feed spout 29 of each of the throwing wheel assemblies 25.

It is to be noted from FIG. 5 that when the door 27 is closed the opening into the feed spout 29 lies directly below the delivery pipe 38. Manifestly, the delivery pipe 38 for the upper throwing wheel assembly 25 is shorter than that for the lower throwing wheel assembly 25.

To ensure no (or very little) intermingling of the spent abrasive and contaminants and the clean abrasive, there is provided at the upper end of the conveyor 32 a T-shaped splitter plate 39 with two openings 39A and 39B separated by the stem of the T, the clean abrasive falling through opening 39A to one side of this splitter plate 39 for guidance into the storage hopper 36 while the spent abrasive and contaminants fall through the opening 39B to the other side of the splitter plate 39 and are guided by plates 40 and 41 into the air wash separator 34.

A window is located at location 42 to permit inspection of the abrasive level in the storage hopper 36.

A build-up of abrasive indicated at 43 occurs below the sieve 35 to provide an inclined abrasive surface which is contacted by abrasive passing through the air wash prior to its return to the boot 18. This assists in reducing wear.

There is provision at 44 for extraction of heavy dust from the separator 34, and debris from the boot 18 can be extracted at 45.

Access to the separator 34 is via door 46.

The separator 34 may incorporate a vibratory sieve deck.

The control valves 37 are both pneumatically controlled and sound-proofed, and they open and close independently. They may be otherwise controlled including being hand-operated.

When the motors 26 are shut off, the elevator 32 is allowed to run for a short time with valves 37 open to allow abrasive to be continued to be fed to the throwing wheel assemblies 25. This flooding of the throwing wheel assemblies 25 with abrasive serves to brake them so reducing run-down time.

Constant exhaust air volumes from the separator and the blast cabinet ensure a balanced non-surge arrangement within the machine.

The control panel 47 for the machine is contained within the shot blasting module as shown.

All doors have double labyrinth or other convenient seals.

The blast cabinet module can be other than that described, for example it may be of the fixed table type, the swing table type, T-track type for continuous throughput of workpieces, or roller conveyor type for handling heavier or bulkier workpieces. All of these are well-known to those skilled in the art.

What is claimed is:

1. A shot blasting machine comprising;

(1) a blast cabinet module into which a workpiece to be shot blasted can be conveyed; and (2) a shot blasting module directly connected to the blast cabinet module in communicating relationship therewith, the shot blasting module including:

(A) a casing open to the interior of the blast cabinet module, (B) a swing-out door pivoted on the casing and openable to permit access to the interior thereof, (C) an abrasive throwing wheel assembly mounted on the internal surface of the swing-out door and including a rotatable throwing wheel for impelling abrasive into the blast cabinet module, (D) a motor drivingly coupled to the throwing wheel and mounted on the external surface of the swing-out door, (E) means for delivering spent abrasive and contaminants from the blast cabinet module into a lower region of the shot blasting module, (F) an abrasive/contaminant separator in an upper region of the shot blasting module, (G) an abrasive storage hopper intermediate the upper and lower regions of the shot blasting module for receiving clean abrasive from the separator, (H) a two stage vertical conveyor means adapted simultaneously to direct the spent abrasive and contaminants from the lower region of the shot blasting module into the separator and to deliver clean abrasive from the separator into the storage hopper, (I) a delivery pipe extending from an outlet of the storage hopper to the throwing wheel assembly, (J) a valve at the storage hopper outlet for controlling flow of clean abrasive from the storage hopper into the delivery pipe, and (K) a feed spout forming part of the abrasive throwing wheel assembly and aligned with the outlet of the delivery pipe when the swing-out door is closed to receive clean abrasive from the delivery pipe and direct it into the throwing wheel.

2. A shot blasting machine as claimed in claim 1, in which the swing-out door is apertured to permit driving connection between the motor and the throwing wheel, an apertured rubber sealing plate being provided within the door aperture to provide anti-vibration characteristic to the driving connection and to seal against abrasive leakage.

3. A shot blasting machine as claimed in claim 1 in which the throwing wheel is rotationally reversible.

4. A shot blasting machine as claimed in claim 1 in which the throwing wheel assembly is hoodless.

5. A shot blasting machine as claimed in claim 1, comprising a plurality of vertically-spaced doors, each mounting internally a throwing wheel assembly and externally a driving motor.

6. A shot blasting machine as claimed in claim 1, in which the two-stage vertical conveyor means comprises an endless belt carrying two parallel rows of buckets and which is driven at the top by a geared motor.

7. A shot blasting machine as claimed in claim 6 comprising a splitter plate at the upper end of the vertical conveyor means on its downward run side, which splitter plate operates to separate and guide the spent abrasive and contaminants to the separator, and the clean abrasive to the storage hopper.

8. A shot blasting machine as claimed in claim 1 in which the separator is an air wash separator fed gravitationally with the spent abrasive/contaminant mixture, there being a sieve beneath the air wash separator.

9. A shot blasting machine as claimed in claim 1 comprising a floor level screw tensioning arrangement for the two-stage vertical conveyor means.

10. A shot blasting machine as claimed in claim 1 comprising an anti-run-back device fitted to the two-stage vertical conveyor means.

11. A shot blasting machine as claimed in claim 1 in which the means for delivering spent abrasive and contaminants from the blast cabinet module into the shot blasting module is a feed screw.

12. A shot blasting machine as claimed in claim 1 comprising a dust collector module connected to the blast cabinet module by a short manifold spigot.

13. A shot blasting machine as claimed in claim 12 in which the dust collector unit is a filter unit.

* * * * *